US008355034B2

(12) United States Patent
Byun et al.

(10) Patent No.: US 8,355,034 B2
(45) Date of Patent: Jan. 15, 2013

(54) DRIVING METHOD FOR LOCAL DIMMING OF LIQUID CRYSTAL DISPLAY DEVICE AND APPARATUS USING THE SAME

(75) Inventors: Min-Chul Byun, Goyang-si (KR); Heu me-Il Baek, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 245 days.

(21) Appl. No.: 12/851,373

(22) Filed: Aug. 5, 2010

(65) Prior Publication Data

US 2011/0148940 A1 Jun. 23, 2011

(30) Foreign Application Priority Data

Dec. 18, 2009 (KR) ..... 10-2009-0127549

(51) Int. Cl.
*G09G 5/00* (2006.01)
*G09G 3/28* (2006.01)
*G09G 3/36* (2006.01)

(52) U.S. Cl. ..... 345/690; 345/92; 345/88

(58) Field of Classification Search ..... 345/92, 345/690, 102

See application file for complete search history.

(56) References Cited

U.S. PATENT DOCUMENTS

2007/0296673 A1* 12/2007 Kang et al. ..... 345/92
2010/0060671 A1* 3/2010 Park et al. ..... 345/690

FOREIGN PATENT DOCUMENTS

CN 101325038 A 12/2008
CN 101453813 A 6/2009
CN 101494031 A 7/2009

* cited by examiner

*Primary Examiner* — Kent Chang
*Assistant Examiner* — Kuo Woo
(74) *Attorney, Agent, or Firm* — McKenna Long & Aldridge, LLP

(57) ABSTRACT

A driving method for local dimming of a LCD device includes dividing a frame into a plurality of blocks corresponding to a plurality of dimming blocks of a backlight unit, calculating an average value of each color in a block by analyzing image data of the block and determining, for the block, a local dimming value of each color corresponding to the average value of the color, detecting a maximum value among the average values of respective colors in the block determining a luminance local dimming value corresponding to the maximum value in the block, driving a plurality of LEDs corresponding to the block in the backlight unit on a color basis according to the local dimming value of each color in the block, or a color basis using the same luminance local dimming value according to whether the block is a chromatic color area or an achromatic color area.

11 Claims, 3 Drawing Sheets

DRIVING METHOD FOR LOCAL DIMMING OF LIQUID CRYSTAL DISPLAY DEVICE AND APPARATUS USING THE SAME

This application claims the benefit of Korean Patent Application No. 10-2009-0127549, filed on Dec. 18, 2009, which is hereby incorporated by reference as if fully set forth herein.

BACKGROUND OF THE INVENTION

1. Field of the Invention

The present invention relates to a Liquid Crystal Display (LCD) device, and more particularly, to a driving method for local dimming of an LCD device to prevent color mixing in each block and reduce power consumption, when color backlights are driven by local dimming, and an apparatus using the same.

2. Discussion of the Related Art

Recently, flat panel displays have been popular as video displays, such as LCDs, Plasma Display Panels (PDPs), Organic Light Emitting Diodes (OLEDs), etc.

An LCD device includes a liquid crystal panel for displaying an image on a pixel matrix relying on the electrical and optical characteristics of liquid crystals that exhibit anisotropy in dielectric constant and refractive index, a driving circuit for driving the liquid crystal panel, and a backlight unit for irradiating light onto the liquid crystal panel. The gray scale of each pixel is adjusted by controlling the transmittance of light that passes from the backlight unit through the liquid crystal panel and polarizers through changing the orientation of liquid crystals according to a data signal.

In the LCD device, the luminance of each pixel is determined by the product between the luminance of the backlight unit and the light transmittance of liquid crystals that depends on data. The LCD device employs backlight dimming method for the purposes of increasing a contrast ratio and reducing power consumption. Backlight dimming is a technique that controls backlight luminance and compensates data by analyzing an input image and adjusting a dimming value based on the analysis. For example, a backlight dimming method intended for reducing power consumption reduces the backlight luminance by decreasing the dimming value and increases the luminance through data compensation. Thus the power consumption of the backlight unit is reduced.

Light Emitting Diode (LED) backlight unit using LEDs as a light source have recently been used for a backlight unit. The LEDs boast of high luminance and low power consumption, compared to conventional lamps. Because the LED backlight unit allows for location-based control, they may be driven by local dimming. According to the local dimming technology, the LED backlight unit is divided into a plurality of light emitting blocks and luminance is controlled on a bock-by-block basis. Local dimming may further increase the contrast ratio and decrease the power consumption since the backlight unit and the liquid crystal panel are divided into a plurality of blocks, local dimming values are decided by analyzing data on a block basis, and data is compensated based on the local dimming values.

Although white (W) LEDs that emit white light are typically used as the LED backlight unit, color backlight unit using at least 2-primary color LEDs, that is, color LED backlights with Red (R)/Green (G)/Blue (B) LEDs may be adopted to increase color reproducibility. An LCD device with color LED backlight unit uses a driving method for color local dimming, in which R/G/B LEDs are individually controlled in each block by individually analyzing R/G/B image data on a block basis.

However, since color local dimming is applied to a limited number of blocks, color mixing may occur in a block in which an achromatic color coexists with a pure color with a high chroma, thus degrading the color purity of an input image.

SUMMARY OF THE INVENTION

Accordingly, the present invention is directed to a driving method for local dimming of a Liquid Crystal Display (LCD) device and an apparatus using the same that substantially obviate one or more problems due to limitations and disadvantages of the related art.

An object of the present invention is to provide a driving method for local dimming of an LCD device to increase color purity and reduce power consumption by preventing color mixing in a block during color local dimming, and an apparatus using the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a driving method for local dimming of an LCD device includes dividing a frame into a plurality of blocks corresponding to a plurality of dimming blocks into which a backlight unit is divided so that the backlight unit is driven on a block basis, calculating an average value of each color in a block by analyzing image data of the block and determining, for the block, a local dimming value of each color corresponding to the average value of the color, detecting a maximum value among the average values of respective colors in the block, determining a luminance local dimming value corresponding to the maximum value in the block, calculating a number of achromatic color pixels in the block by analyzing the image data of the block, calculating a gain value for the block based on a ratio of the number of achromatic color pixels to a total number of pixels in the block, determining whether the block is a chromatic color area or an achromatic color area by comparing the gain value with a predetermined threshold, selecting the local dimming value of each color in the block and outputting the local dimming value of each color in the block, if the block is determined to be a chromatic color area, selecting the luminance local dimming value of the block and outputting the luminance local dimming value of the block, if the block is determined to be an achromatic color area, driving a plurality of Light Emitting Diodes (LEDs) corresponding to the block in the backlight unit on a color basis according to the local dimming value of each color in the block, if the local dimming value of each color in the block is output, and driving the plurality of LEDs corresponding to the block in the backlight unit on a color basis using the same luminance local dimming value, if the luminance local dimming value of the block is output.

The driving method may further include compensating the image data of the block using the local dimming value of each color in the block or the luminance local dimming value of the block.

In another aspect of the present invention, a driving apparatus for local dimming of an LCD device includes a backlight unit divided into a plurality of dimming blocks each having a plurality of LEDs, so that the LEDs are driven on a color basis in each block, a local dimming driver for dividing a frame into a plurality of blocks corresponding to the plurality of dimming blocks of the backlight unit, determining a local dimming value of each color in the block or a luminance local dimming value of the block by analyzing image data of the block, calculating a gain value for the block according to a number of achromatic color pixels in the block, determining whether the block is a chromatic color area or an achromatic color area according to the gain value, selecting the local dimming value of each color in the block and outputting the local dimming value of each color in the block, if the block is determined to be a chromatic color area, and selecting the luminance local dimming value of the block and outputting the luminance local dimming value of the block, if the block is determined to be an achromatic color area, and a backlight driver for driving the backlight unit on a dimming block basis and on a color basis according to the local dimming value of each color in the block or the luminance local dimming value of the block.

The local dimming driver may include a frame divider for dividing the frame into the plurality of blocks and outputting block information, a first image analyzer for receiving the image data of the block according to the block information received from the frame divider and calculating an average value of each color in the block by analyzing the image data of the block, a first dimming value decider for determining, for the block, the local dimming value of each color corresponding to the average value of each color received from the first image analyzer, a second image analyzer for receiving the average values of respective colors of the block from the first image analyzer according to the block information received from the frame divider, detecting a maximum value among the average values of the respective colors in the block, a second dimming value decider for determining a luminance local dimming value corresponding to the maximum value in the block, an achromatic color analyzer for calculating the number of achromatic color pixels in the block by analyzing the image data of the block according to the block information received from the frame divider, a gain value calculator for calculating the gain value for the block based on a ratio of the number of achromatic color pixels to a total number of pixels in the block, an area decider for determining whether the block is a chromatic color area or an achromatic color area by comparing the gain value with a predetermined threshold, and a selector for selecting an output of the first or second dimming value decider according to an area signal received from the area decider and outputting the selected output to the backlight driver.

The local dimming driver may further include a data compensator for compensating the image data of the block using the local dimming value of each color in the block or the luminance local dimming value of the block, received from the selector.

If the gain value of the block is G, the number of achromatic color pixels in the block is Na, and the total number of pixels in the block is Mt, the gain value calculator may calculate the gain value of the block by the following equation, $$G = 1 + \frac{Na}{Mt}$$

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
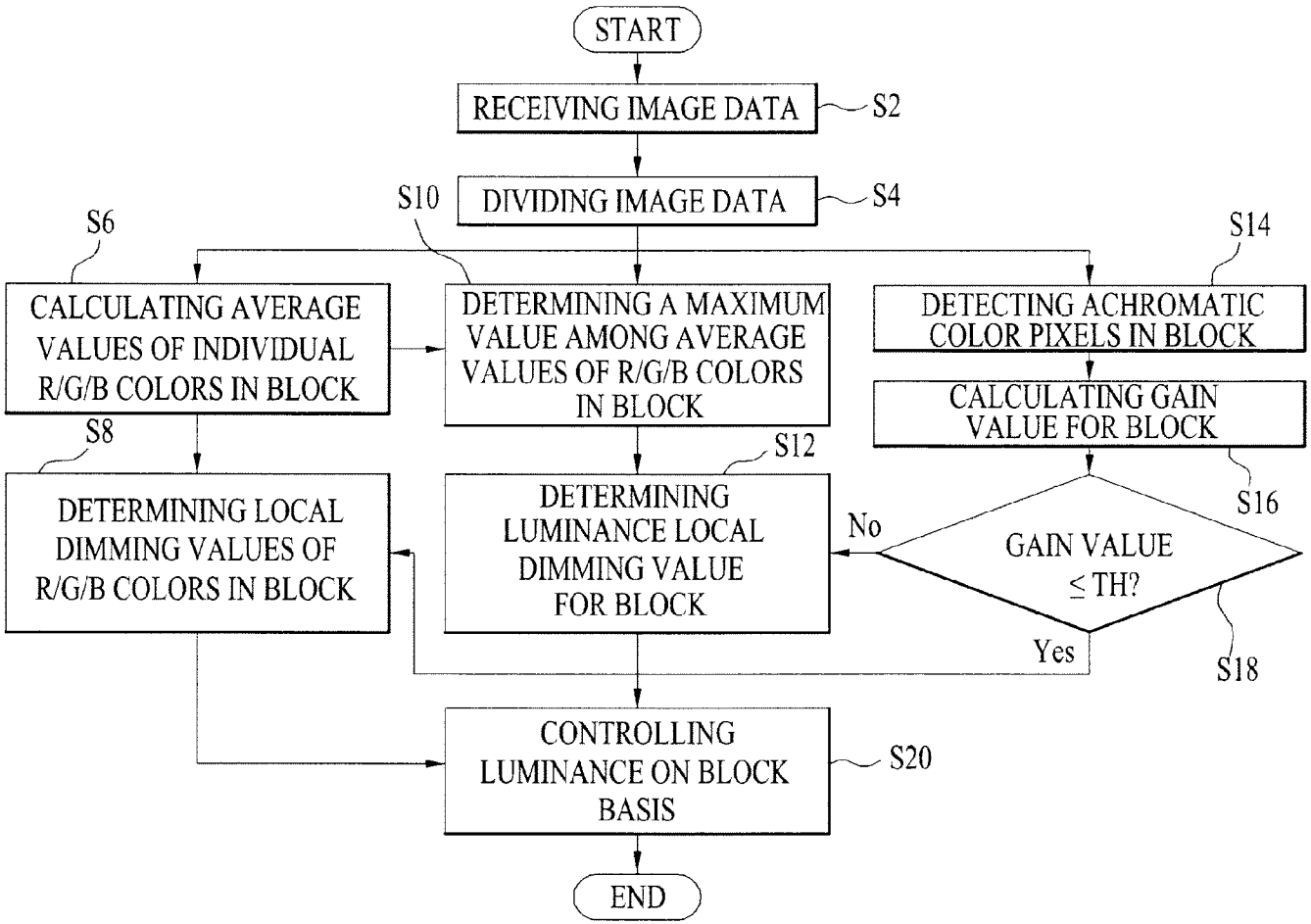
FIG. 1 is a flowchart illustrating a driving method for local diming of a Liquid Crystal Display (LCD) device according to an exemplary embodiment of the present invention.

FIG. 1 is a flowchart illustrating a driving method for local diming of a Liquid Crystal Display (LCD) device according to an exemplary embodiment of the present invention.

An LCD device according to the present invention uses a Light Emitting Diode (LED) backlight unit which is divided into a plurality of diming blocks and driven on a block basis, for local dimming. Each of the dimming blocks includes an Red (R) LED string in which a plurality of R LEDs are connected serially, a Green (G) LED string in which a plurality of G LEDs are connected serially, and a Blue (B) LED string in which a plurality of B LEDs are connected serially. The LED backlight unit may be driven by individually controlling the luminance of the R, G and B strings according to their R, G and B dimming values (i.e. dimming levels) by color local dimming. Also, the LED backlight unit may be driven by controlling the luminance of the R, G and B strings of each block with the same dimming value by luminance local dimming.

Referring to FIG. 1, the LCD device receives image data in step S2. In step S4, the LCD device divides a frame into a plurality of blocks corresponding to a plurality of diming blocks into which the backlight unit is divided so that the backlight unit is driven on a block basis, and outputs the image data on a block basis.

The LCD device detects the average values of individual R, G and B data, that is, the average values of individual colors in each block in step S6 and determines the local dimming values (i.e. dimming levels) of the respective colors according to the average values of the respective colors in the block in step S8. Specifically, the local dimming value of each of the colors R, G and B in each block is determined according to the average value of the color in the block in step S8. In general, local dimming values of the respective colors are preliminarily mapped to average values of the respective colors in a look-up table stored in a memory by a designer. Therefore, a local dimming value corresponding to the average value of each color is selected for the color from the preset look-up table in step S8.

In step S10, a maximum value among the average values of respective colors is detected in the block. A luminance local dimming value is determined for the block according to the maximum value in the block in step S12. Luminance local dimming values are also preliminarily mapped to maximum values for blocks in a look-up table by the designer. Hence, a luminance dimming value corresponding to the maximum value in the block is selected for the block from the preset look-up table in step S12.

In steps S14 and S16, achromatic color pixels of the block are analyzed and a gain value is determined for the block according to the result of the analysis.

To be more specific, the LCD device determines for each pixel of the block whether the pixel is an achromatic color pixel and counts the number of achromatic color pixels in the block, that is, the number of pixels in an achromatic color area of the block in step S14. As expressed as [Equation 1], the maximum value $MAX_p$ of each pixel is compared with the product between the minimum value $MIN_p$ of the pixel and a predetermined constant $\chi$, and if the maximum value $MAX_p$ is less than the product, it is determined that the pixel is an achromatic color pixel. The predetermined constant $\chi$ may be changed according to the intention of the designer, for example, it may be set to "2".

$$MAX_p < \chi \times MIN_p \quad \text{[Equation 1]}$$

By [Equation 1], a decision is made over each pixel in each block as to whether the pixel is an achromatic color pixel in the block and the number of achromatic color pixels in the block is counted.

In step S16, a gain value is calculated for the block based on the number Na of achromatic color pixels in the block by [Equation 2].

$$G = 1 + \frac{Na}{Mt} \quad \text{[Equation 2]}$$

Where G denotes the gain value of the block, Na denotes the number of achromatic color pixels in the block, and Mt denotes the total number of pixels in the block. It is noted from [Equation 2] that as the number of achromatic color pixels in a block increases, the gain value of the block increases and as the number of achromatic color pixels in the block decreases, the gain value of the block decreases.

In step S18, the gain value G is compared with a predetermined threshold TH. If the gain value G is equal to or less than the threshold TH, the block is determined to be a chromatic area and the local dimming values of the respective colors in the block are selected and output in step S8. On the other hand, if the gain value G is larger than the threshold TH, the luminance local dimming value of the block is selected and output in step S12. The threshold TH may be changed according to the intention of the designer, for example, it may be set to "1.3".

When the local dimming values of the respective colors in the block are received, the local dimming values are converted to R, G and B Pulse Width Modulation (PWM) signals with duty ratios corresponding to the local dimming values and R, G and B LED driving signals corresponding to the R, G and B PWM signals are respectively provided to the R, G and B strings of the block, thereby controlling the luminance of the LED backlight by color local dimming in step S20. Meanwhile, if the luminal local dimming value of the block is received, the luminance local dimming value is converted to R, G and B PWM signals with the same duty ratio and R, G and B LED driving signals corresponding to the R, G and B PWM signals are respectively provided to the R, G and B strings of the block, thereby controlling the luminance of the LED backlight by luminance local dimming in step S20.

In accordance with the driving method for local dimming of an LCD device according to the present invention as described above, achromatic color pixels are analyzed on a block basis, and a gain value G proportional to the ratio of the number of achromatic color pixels to a total number of pixels is calculated for each block. If the block is determined to be a chromatic color area according to the gain value G, an LED backlight unit is driven by color local dimming, whereas if the block is determined to be an achromatic color area according to the gain value G, the LED backlight unit is driven by luminance local dimming. Because each block can be accurately identified as a chromatic or achromatic color area without a decrease in gain value, power consumption is reduced by color local dimming driving for the chromatic color area, whereas color mixing is prevented and thus color purity is improved by luminance local dimming driving for the achromatic color area.

Figure 2:
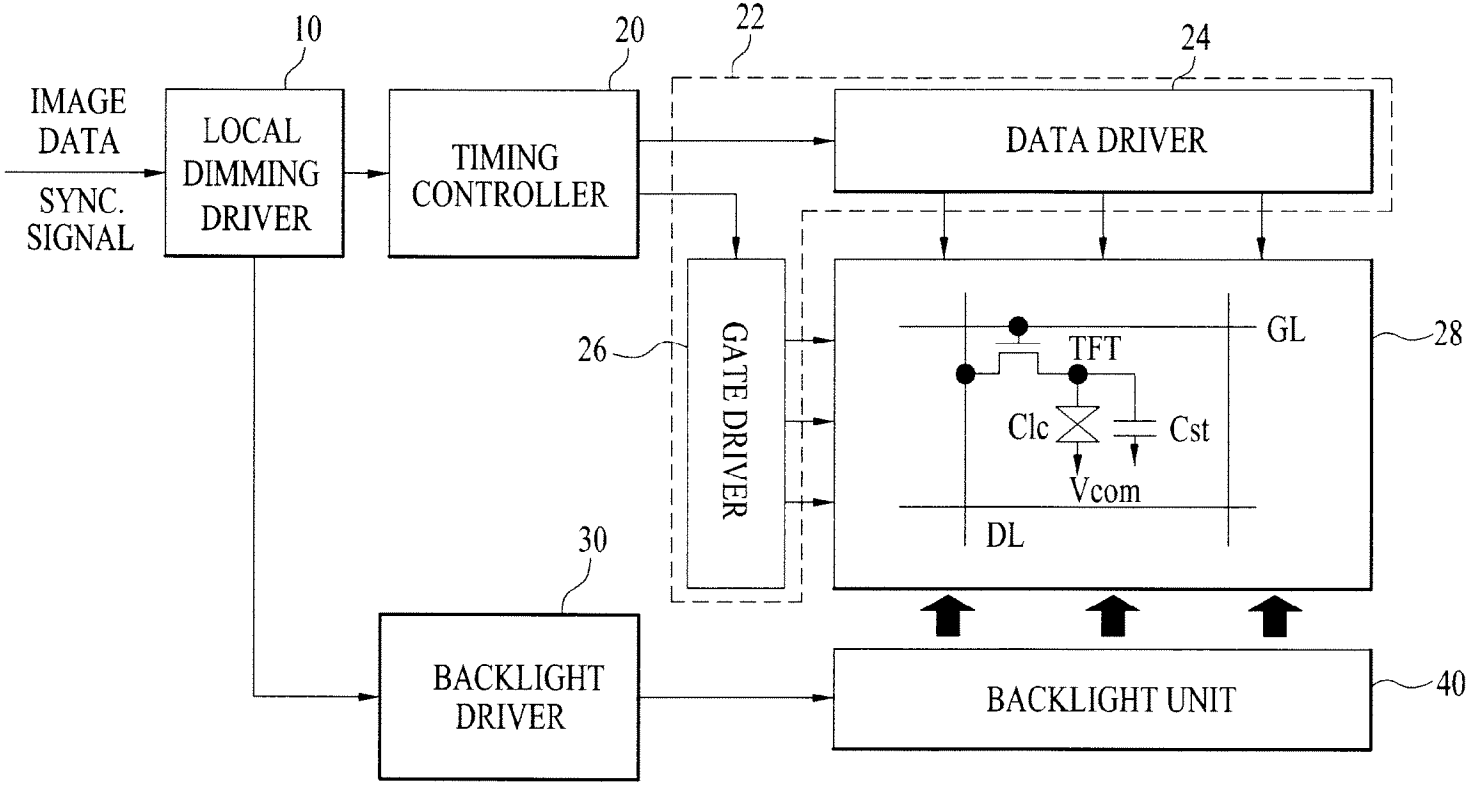
FIG. 2 is a block diagram of an LCD device according to an exemplary embodiment of the present invention.

FIG. 2 is a schematic block diagram of an LCD device according to an exemplary embodiment of the present invention.

Referring to FIG. 2, the LCD device includes a local dimming driver 10 for determining a local dimming value on a color basis for each block or a luminance local dimming value on a block basis by analyzing input image data on a block basis and compensating data according to the local dimming values of respective colors in each block or the luminance local dimming value of each block, a timing controller 20 for providing the data received from the local dimming driver 12 to a panel driver 22 and controlling a driving timing of the panel driver 22, a backlight driver 30 for driving an LED backlight unit 40 on a block basis based on the color local dimming values or the luminance local dimming value received from the local dimming driver 10, and a liquid crystal panel driven by a data driver 24 and a gate driver 26 of the panel driver 22. The local dimming driver 10 may be provided inside the timing controller 20.

In operation, the local dimming driver 10 analyzes input image data on a block basis using synchronization signals and determines local dimming values for the respective colors in each block or a luminance local dimming value for each block according to the result of the analysis. The local dimming values of the respective colors in each block are determined based on the average values of the respective colors in the block. The luminance local dimming value of each block is determined based on a maximum value among the average values of respective colors in the block. The local dimming driver 10 analyzes achromatic color pixels in each block and calculates a gain value G with which to determine the block to be an achromatic color area or a chromatic color area by [Equation 1] and [Equation 2]. If the gain value G is equal to or less than a threshold, the local dimming driver 10 determines the block to be a chromatic color area, selects the local dimming values of the respective colors of the block, and outputs the local diming values of the respective colors to the backlight driver 30. On the contrary, if the gain value G is larger than the threshold, the local dimming driver determines the block to be an achromatic color area, selects the luminance local dimming value of the block, and outputs the luminance local dimming value to the backlight driver 30. The local dimming driver 10 compensates the input image data using the local dimming values of the respective colors determined on a block basis and outputs the compensated image data to the timing controller 20, thereby compensating for a luminance decrease caused by the backlight unit 40 by local dimming.

The timing controller 20 orders the data received from the local dimming driver 10 and outputs the ordered data to the data driver 24 of the panel driver 22. The timing controller 20 generates data control signals for controlling driving timings of the data driver 24 and gate control signals for controlling driving timings of the gate driver 26, using a plurality of synchronization signals received from the local dimming driver 10, specifically a vertical synchronization signal, a horizontal synchronization signal, a data enable signal, and a dot clock signal, and outputs the data control signals and the gate control signals respectively to the data driver 24 and the gate driver 26. Meanwhile, the timing controller 20 may further include an overdriving circuit (not shown) for modulating data by applying an overshoot value or an undershoot value to the data according to a data difference between successive frames in order to increase the response speed of liquid crystals.

The panel driver 22 includes the data driver 24 for driving data lines DL of the liquid crystal panel 28 and gate lines GL of the liquid crystal panel 28.

The data driver 24 converts digital video data received from the timing controller 24 to analog data signals (pixel voltage signals) using gamma voltages in response to the data control signals received from the timing controller 20 and provides the analog data signals to the data lines DL of the liquid crystal panel 28.

The gate driver 26 sequentially drives the gate lines GL of the liquid crystal panel 28 in response to the gate control signals received from the timing controller 20.

The liquid crystal panel 28 displays an image through a pixel matrix having a plurality of pixels arranged. Each pixel represents a desired color by combining red, green and blue sub-pixels that control light transmittance through changing the orientation of the liquid crystals according to a luminance-compensated data signal. Each of the sub-pixels includes a Thin Film Transistor (TFT) connected to a gate line GL and a data line DL, and a liquid crystal capacitor Clc and a storage capacitor Cst that are connected to the TFT in parallel. The liquid crystal capacitor Clc is charged with a different voltage between a data signal supplied to a pixel electrode through the TFT and a common voltage Vcom supplied to a common electrode and drives a liquid crystal according to the charged voltage, to thereby control light transmittance. The storage capacitor Cst maintains the voltage charged at the liquid crystal capacitor Clc to be stable.

The backlight unit 40 is divided into a plurality of dimming blocks and driven on a block basis. Each of the dimming blocks includes an R LED string in which a plurality of R LEDs are connected serially, a G LED string in which a plurality of G LEDs are connected serially, and a B LED string in which a plurality of B LEDs are connected serially. The LED backlight unit 40 is driven by individually controlling the luminance of the R, G and B strings according to their R, G and B dimming values (i.e. dimming levels) by color local dimming or by controlling the luminance of the R, G and B strings of each block with the same dimming value by luminance local dimming.

The backlight driver 30 drives the backlight unit 40 on a block basis or on a color basis according to the dimming values of the respective colors in each block or the luminance dimming value of each block, thus controlling the luminance of the backlight unit 40 on a block basis and on a color basis. If the block is determined to be a chromatic color area by the local dimming driver 10, the backlight driver 30 converts the local dimming values of the individual colors of the block received from the local dimming driver 10 to R, G and B PWM signals with duty ratios corresponding to the local dimming values, generates R, G and B LED driving signals corresponding to the R, G and B PWM signals, and provides the R, G and B LED driving signals respectively to the R, G and B strings of the block, thereby controlling the luminance of the chromatic block by color local dimming. Meanwhile, if the block is determined to be an achromatic color area by the local dimming driver 10, the backlight driver 30 converts the luminance local dimming value of the block received from the local dimming driver 10 to R, G and B PWM signals with the same duty ratio, generates R, G and B LED driving signals corresponding to the R, G and B PWM signals, and provides the R, G and B LED driving signals respectively to the R, G and B strings of the block, thereby controlling the luminance of the achromatic block by luminance local dimming.

Figure 3:
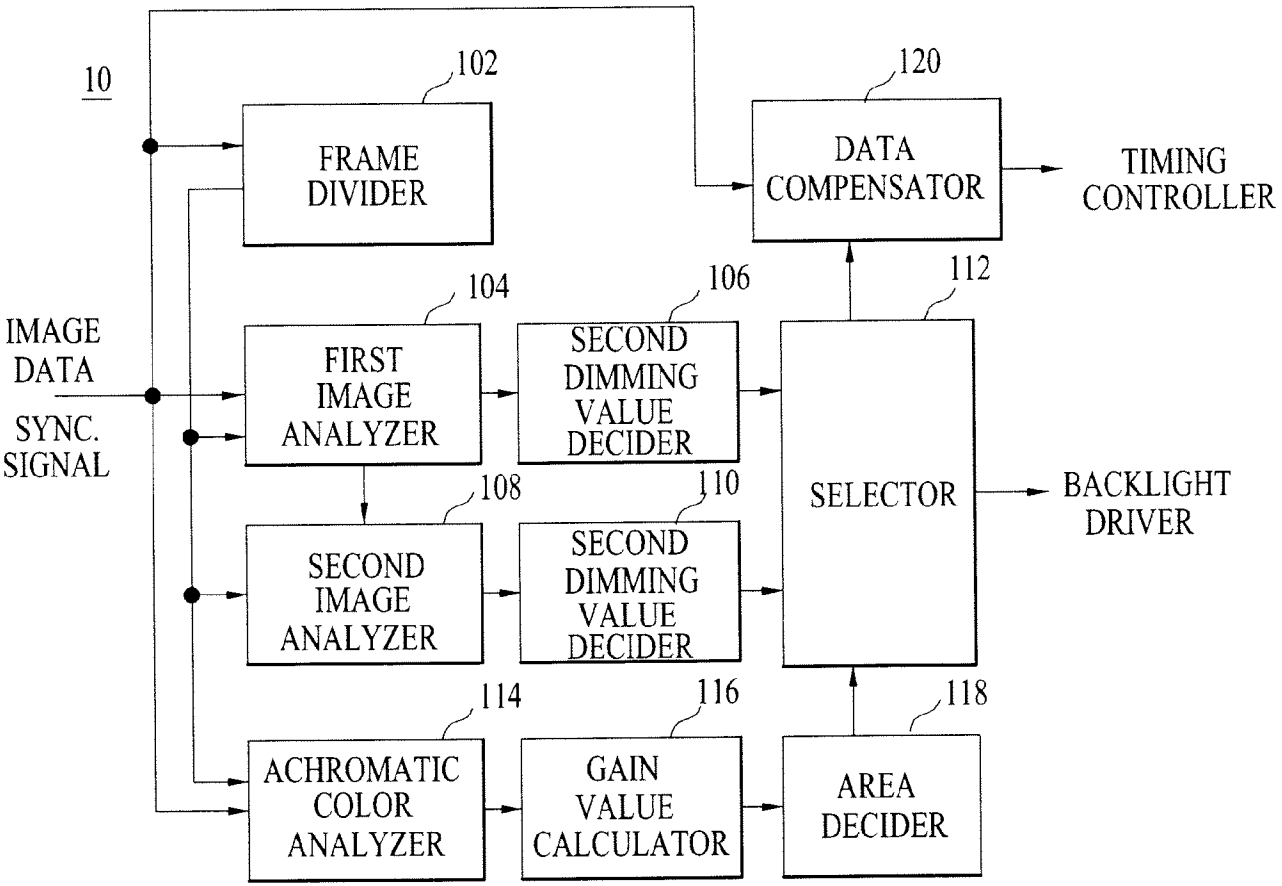
FIG. 3 is a detailed block diagram of a local dimming driver illustrated in FIG. 1.

FIG. 3 is a detailed block diagram of the local dimming driver 10 illustrated in FIG. 2.

Referring to FIG. 3, the local dimming driver 10 includes a frame divider 102, a first image analyzer 104, a first dimming value decider 106, a second image analyzer 108, a second dimming value decider 110, a selector 112, an achromatic color analyzer 114, a gain calculator 116, an area decider 119, and a data compensator 120.

The frame divider 102 divides a frame into a plurality of block corresponding to a plurality of dimming blocks of the backlight unit 40 and outputs block information identifying each block to the first and second image analyzers 104 and 108.

The first image analyzer 104 receives image data of a block based on the block information received from the frame divider 102 and calculates the average values of individual R, G and B data, that is, the average values of the respective colors in the block.

The first dimming value decider 106 determines the local dimming values of the respective colors of the block according to the average values of the respective colors in the block, received from the first image analyzer 104. Specifically, the first dimming value decider 106 determines the local dimming values of R, G and B colors in each block according to the average values of the R, G and B colors in the block. In general, local dimming values for the respective colors are preliminarily mapped to averages values for the respective colors in a look-up table stored in a memory by the designer. Accordingly, the first dimming value decider 106 selects a local dimming value corresponding to an average value for each color from the look-up table.

The second image analyzer 108 receives the average values of the respective colors in the block from the first image analyzer 104 based on the block information received from the frame divider 102, detects the maximum value among the average values of the respective colors in the block.

The second dimming value decider 110 determines a luminance local dimming value for the block according to the maximum value in the block, received from the second image analyzer 108. A luminance local dimming value for each block is preliminarily mapped to the maximum value in the block in a look-up table stored in a memory by the designer. Accordingly, the second dimming value decider 110 selects a luminance local dimming value corresponding to the maximum value of the block from the look-up table.

The achromatic color analyzer 114 receives the image data of the block based on the block information received from the frame divider 102 and analyzes achromatic color pixels in the block. To be more specific, the achromatic color analyzer 114 detects the maximum value $MAX_p$ and minimum value $MIN_p$ of each pixel in the image data of the block and compares the maximum value $MAX_p$ of the pixel with the products of the minimum value $MIN_p$ of the pixel and a predetermined constant $\chi$. If the maximum value $MAX_p$ of the pixel is less than the product, the achromatic color analyzer 114 determines that the pixel is an achromatic color pixel. The achromatic color analyzer 114 counts the number of achromatic color pixels in the block that are determined in the above manner.

The gain calculator 116 calculates the ratio of the number of achromatic color pixels Na received from the achromatic color analyzer 114 to the total number Mt of pixels in the block and adds 1 to the ratio by [Equation 2], thus creating a gain value G for the block.

The area decider 118 compares the gain value G received from the gain value calculator 116 with a predetermined threshold TH. If the gain value G is equal to or less than the threshold TH, the area decider 118 determines that the block is a chromatic color area and thus outputs a chromatic color area signal to the selector 112. On the other hand, if the gain value G is larger than the threshold TH, the area decider 118 determines that the block is an achromatic color area and thus outputs an achromatic color area signal to the selector 112.

The selector 112 selects the output of the first dimming value decider 106 or the output of the second dimming value decider 110 according to the area signal received from the area decider 118 and outputs the selected output to the backlight driver 30 and the data compensator 120. Upon receipt of the chromatic color area signal from the area decider 118, the selector 112 selects the local dimming values of the respective colors of the block received from the first dimming value decider 106 and outputs the local dimming values to the backlight driver 30. Upon receipt of the achromatic color area signal from the area decider 118, the selector 112 selects the luminance local dimming value of the block received from the second dimming value decider 110 and outputs the luminance local dimming value to the backlight driver 30 and the data compensator 120.

The data compensator 120 calculates a compensation gain value for each pixel using the local dimming values of the individual colors for the block, or the luminance local dimming value for the block and an optical profile of a predetermined light source, compensates the luminance of the input image data by applying the compensation gain value to the input image data, and outputs the luminance-compensated image data to the timing controller 20.

As described above, the driving apparatus for local dimming of an LCD device according to the present invention analyzes achromatic color pixels in each block, calculates a gain value G proportional to the ratio of the number of achromatic color pixels to the total number of pixels in the block, drives the LED backlight unit by color local dimming, if the block is determined to be a chromatic color area according to the gain value G, and drives the LED backlight unit by luminance local dimming, if the block is determined to be an achromatic color area. Thus, each block can be accurately identified as a chromatic or achromatic color area without a decrease in gain value. As a consequence, power consumption can be reduced in a chromatic color area by color local dimming, and color purity can be increased by preventing color mixing in an achromatic color area by luminance local dimming.

As is apparent from the above description, the driving method for local dimming of an LCD device and an apparatus using the same analyze achromatic color pixels on a block basis and accurately identify each block as a chromatic or achromatic color area according to a gain value of the block proportional to the ratio of the number of achromatic color pixels to the total number of pixels in the block.

When a block is identified as a chromatic color area according to the gain value of the block, the LED backlight unit is driven by color local dimming. If a block is identified as an achromatic color area, the LED backlight is driven by luminance local dimming. Therefore, power consumption can be reduced in the chromatic color area without a decrease in gain value by color local dimming, whereas color mixing is prevented and thus color purity is improved in the achromatic color area by luminance local dimming.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A driving method for local dimming of a Liquid Crystal Display (LCD) device, comprising:

dividing a frame into a plurality of blocks corresponding to a plurality of dimming blocks into which a backlight unit is divided so that the backlight unit is driven on a block basis;

calculating an average value of each color in a block by analyzing image data of the block and determining, for the block, a local dimming value of each color corresponding to the average value of the color;

detecting a maximum value among the average values of respective colors in the block and determining a luminance local dimming value corresponding to the maximum value of the block;

calculating a number of achromatic color pixels in the block by analyzing the image data of the block, wherein a maximum value of each pixel is compared with the product between a minimum value of the pixel and a predetermined constant, and when the maximum value is less than the product, it is determined that the pixel is the achromatic color pixel;

calculating a gain value for the block based on a ratio of the number of achromatic color pixels to a total number of pixels in the block;

determining whether the block is a chromatic color area or an achromatic color area by comparing the gain value with a predetermined threshold;

selecting the local dimming value of each color in the block and outputting the local dimming value of each color in the block, when the block is determined to be a chromatic color area;

selecting the luminance local dimming value of the block and outputting the luminance local dimming value of the block, when the block is determined to be an achromatic color area;

driving a plurality of Light Emitting Diodes (LEDs) corresponding to the block in the backlight unit on a color basis according to the local dimming value of each color in the block, when the local dimming value of each color in the block is output; and driving the plurality of LEDs corresponding to the block in the backlight unit on a color basis using the same luminance local dimming value, when the luminance local dimming value of the block is output.

2. The driving method according to claim 1, further comprising compensating the image data of the block using the local dimming value of each color in the block or the luminance local dimming value of the block.

3. The driving method according to claim 1, wherein when the gain value of the block is G, the number of achromatic color pixels in the block is Na, and the total number of pixels in the block is Mt, the gain value calculation comprises calculating the gain value of the block by the following equation, $$G = 1 + \frac{Na}{Mt}.$$

4. A driving apparatus for local dimming of a Liquid Crystal Display (LCD) device, comprising:

a backlight unit divided into a plurality of dimming blocks each having a plurality of color Light Emitting Diodes (LEDs), so that the LEDs are driven on a color basis in each block;

a local dimming driver for dividing a frame into a plurality of blocks corresponding to the plurality of dimming blocks of the backlight unit, determining a local dimming value of each color in the block or a luminance local dimming value of the block by analyzing image data of the block, calculating a gain value for the block according to a number of achromatic color pixels in the block, determining whether the block is a chromatic color area or an achromatic color area according to the gain value, selecting the local dimming value of each color in the block and outputting the local dimming value of each color in the block, when the block is determined to be a chromatic color area, and selecting the luminance local dimming value of the block and outputting the luminance local dimming value of the block, when the block is determined to be an achromatic color area; and a backlight driver for driving the backlight unit on a dimming block basis and on a color basis according to the local dimming value of each color in the block or the luminance local dimming value of the block, wherein a maximum value of each pixel is compared with the product between a minimum value of the pixel and a predetermined constant, and when the maximum value is less than the product, it is determined that the pixel is the achromatic color pixel.

5. The driving apparatus according to claim 4, wherein the local dimming driver comprises;

a frame divider for dividing the frame into the plurality of blocks and outputting block information;

a first image analyzer for receiving the image data of the block according to the block information received from the frame divider and calculating an average value of each color in the block by analyzing the image data of the block;

a first dimming value decider for determining, for the block, the local dimming value of each color corresponding to the average value of each color received from the first image analyzer;

a second image analyzer for receiving the average values of respective colors of the block from the first image analyzer according to the block information received from the frame divider, detecting a maximum value among the average values of the respective colors in the block;

a second dimming value decider for determining a luminance local dimming value corresponding to the maximum value in the block;

an achromatic color analyzer for calculating the number of achromatic color pixels in the block by analyzing the image data of the block according to the block information received from the frame divider;

a gain value calculator for calculating the gain value for the block based on a ratio of the number of achromatic color pixels to a total number of pixels in the block;

an area decider for determining whether the block is a chromatic color area or an achromatic color area by comparing the gain value with a predetermined threshold; and a selector for selecting an output of the first or second dimming value decider according to an area signal received from the area decider and outputting the selected output to the backlight driver.

6. The driving apparatus according to claim 5, wherein the local dimming driver further comprises a data compensator for compensating the image data of the block using the local dimming value of each color in the block or the luminance local dimming value of the block, received from the selector.

7. The driving apparatus according to claim 5, wherein when the gain value of the block is G, the number of achromatic color pixels in the block is Na, and the total number of pixels in the block is Mt, the gain value calculator calculates the gain value of the block by the following equation, $$G = 1 + \frac{Na}{Mt}.$$

8. The driving method according to claim 3, wherein as the number of achromatic color pixels in the block increases, the gain value of the block increases and as the number of achromatic color pixels in the block decreases, the gain value of the block decreases.

9. The driving method according to claim 8, wherein when the gain value is equal to or less than the threshold, the block is determined to be the chromatic color area and when the gain value is larger than the threshold, the block is determined to be the achromatic color area.

10. The driving apparatus according to claim 7, wherein as the number of achromatic color pixels in the block increases, the gain value of the block increases and as the number of achromatic color pixels in the block decreases, the gain value of the block decreases.

11. The driving apparatus according to claim 10, wherein when the gain value is equal to or less than the threshold, the block is determined to be the chromatic color area and when the gain value is larger than the threshold, the block is determined to be the achromatic color area.

* * * * *